United States Patent [19]

Giallourakis

[11] Patent Number: 4,821,360

[45] Date of Patent: Apr. 18, 1989

[54] POLISHING PAD

[75] Inventor: Michael A. Giallourakis, Tarpon Springs, Fla.

[73] Assignee: Sponge Fishing Co, Inc., Tarpon Springs, Fla.

[21] Appl. No.: 147,620

[22] Filed: Jan. 19, 1988

Related U.S. Application Data

[60] Continuation of Ser. No. 48,554, May 11, 1987, which is a division of Ser. No. 676,949, Nov. 30, 1984, Pat. No. 4,670,962.

[51] Int. Cl.[4] ..... A47K 7/03

[52] U.S. Cl. ..... 15/244.3; 401/201

[58] Field of Search ..... 15/118, 222, 244.3; 401/201

[56] References Cited

U.S. PATENT DOCUMENTS

| | | | |
|---|---|---|---|
| 1,345,026 | 7/1920 | Riley | 15/222 X |
| 1,820,256 | 8/1931 | Stewart | 15/244 B |
| 4,240,193 | 12/1980 | Krein | 29/451 |
| 4,437,704 | 3/1984 | Hovsepians | 5/490 X |
| 4,457,640 | 7/1984 | Anderson | 401/201 X |
| 4,504,990 | 3/1985 | Scales et al. | 5/470 X |

FOREIGN PATENT DOCUMENTS

| | | | |
|---|---|---|---|
| 164586 | 11/1949 | Austria | 401/201 |
| 504234 | 7/1954 | Canada | 15/222 |
| 862511 | 12/1940 | France | 401/201 |

*Primary Examiner*—Chris K. Moore

*Attorney, Agent, or Firm*—James Creighton Wray

[57] ABSTRACT

A polishing pad is formed by providing a sponge or sponge-like material with a soft, loosely knitted covering. The covering is preferably double layered, and is provided with an expandable opening so that the sponge can be readily removed or inserted.

8 Claims, 1 Drawing Sheet

FIG. 5
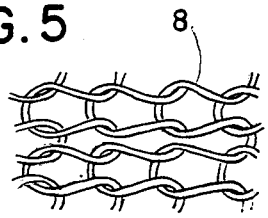
FIG. 1
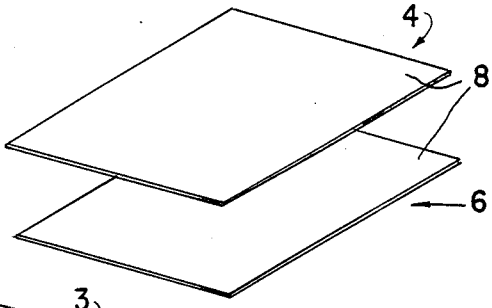
FIG. 1A
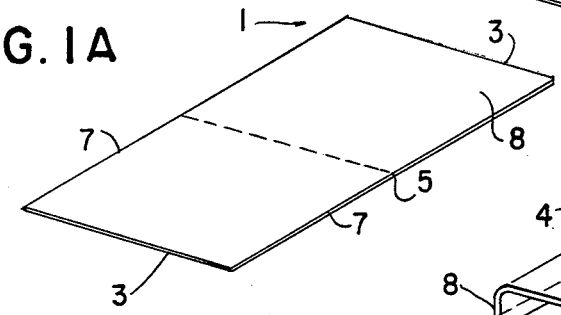
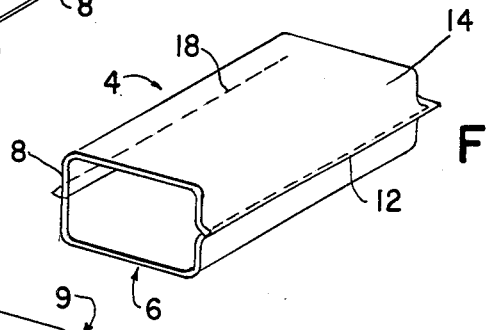
FIG. 2
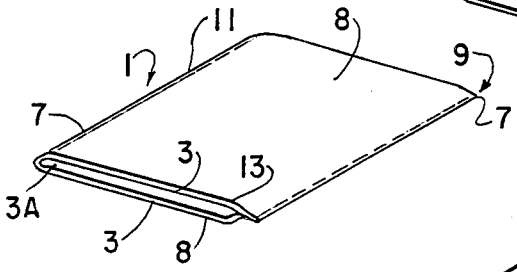
FIG. 2A
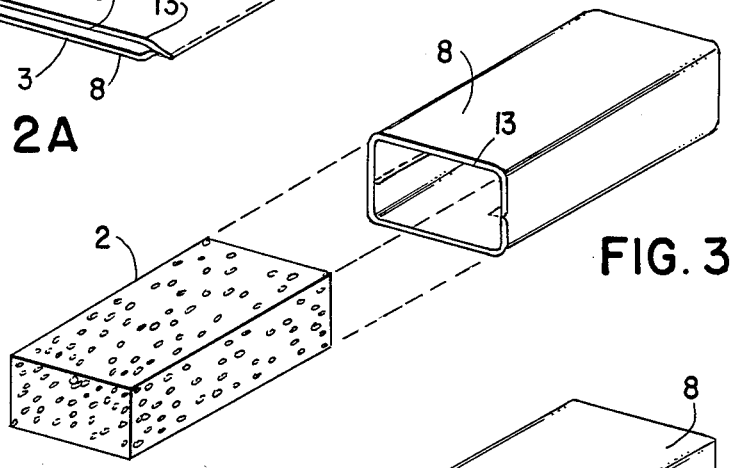
FIG. 3
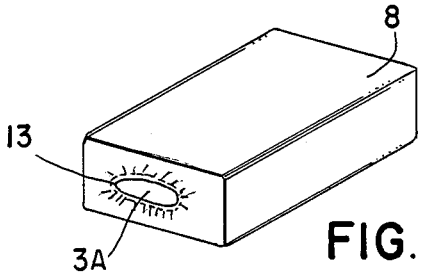
FIG. 4

POLISHING PAD

This is a continuation of application Ser. No. 048,554 filed May 11, 1987, which is a division of Ser. No. 676,949 filed Nov. 30, 1984, now U.S. Pat. No. 4,670,962 issued June 9, 1987.

BACKGROUND OF THE INVENTION

Many commercially available waxes are applied in a liquid state and are then buffed to a high gloss after the liquid wax has dried-and formed a hazy deposit.

In order to buff the wax, it is desirable to use a soft fabric which is nonabrasive to the surace being buffed. In the past, it has been common to use discarded clothing or other rags consisting of woven cotton or cotton polyester blends.

In many instances, buffing rags are inadequate because the hazy deposit on the surface of the object has a tendancy to build up on the surface of the woven cloth or rag. When this build up occurs, continued buffing will not achieve a desirable shine and may in many instances become abrasive and damage the surface.

To prevent build up, the cloth material must be constantly shifted and turned. Also, in order to generate a cushion to absorb the pressure exerted in the buffing process, one ordinarily has to gather the cloth in one hand. This has a tendancy to create folds or wrinkles which reduce the effectiveness of the buffing material.

As an alternative buffing material, a material commonly and generically referred to as "polishing cloth" is readily available in the market. The cloth consists of a knitted fabric, and therefore, presents a softer buffing material. Furthermore, the knitted cloth has relatively large spaces between the interlooped strands of fabric, and therefore, presents a surface which is not as susceptible to build up as the woven fabric.

The commercially available "polishing cloth" is generally sold in large rolls. An amount necessary for polishing a particular object is removed from the roll in usually large rectangular sheets. The material is easily wasted and suffers from the same drawback as ordinary rags or woven material in that in order to create a cushion against the pressure exerted from buffing, the material must be gathered up in one hand. As previously mentioned, this creates unwanted wrinkles and folds that diminish the buffing capacity of the material.

SUMMARY OF THE INVENTION

The present invention uses loosely knitted polishing cloth to cover a porous foam core such as a poly sponge. The sponge gives shape to the polishing cloth and prevents the formation of wrinkles and folds.

Preferably, the loosely knitted material is formed into a pocket having an expandable opening so that the sponge can be inserted through the opening.

Preferably, the loosely knitted material is double layered to further enhance the softness of the covering and inorder to make the covering reversible.

Inorder to cover a poly sponge with the desired material, the material is preferably cut into rectangular sheets and laid out flat. The sheet is then folded end-to-end about an imaginery transverse fold axis to form two equal halves which are joined at the fold axis. It should be understood that the two halves retain a rectangular shape and are positioned one on top of the other so that the sides of each correspond to the sides of the other.

After folding, the two halves are sewn together along two sides to create a pocket with two seams extending along two peripheral edges. Preferbly, an opening for the pocket is formed where the former ends of the rectangular sheet were brought together in the folding step. alternatively, the opening can occur along any unsewn edge.

The pocket so formed is then provided with a band of elastic material sewn along the edges of the opening in a stretched position so that the elastic band causes the opening to be normally closed.

A poly sponge is then inserted into the pocket by first spreading and stretching the elastic opening. After insertion of the sponge, the elastic band insures that the sponge and the covering do not accidently become separated. The pocket should have dimensions which coincide to the dimensions of the poly sponge such that when the poly sponge is fully inserted in the pocket, the pocket takes on the shape of the poly sponge.

As the surface of an object is buffed, the hazy deposit which normally builds up rapidly on the surface of a woven cloth, has a tendency to work its way through the spaces provided in the loosely knitted fabric so that the outer surface of the knitted fabric does not achieve a rapid buildup.

Eventually, when the outer surface does develop a buildup of hazy deposit, the sponge can be removed through the elastic opening, and the covering can be turned inside out to provide a fresh and clean buffing surface.

After use, the covering can be separately washed or it can be washed with the sponge inside. One of the advantages of the present invention is that separate sponges and coverings can be purchased as needed. In other words, the covering and the sponge are not integrated in such a way that as one wears out the other has to be discarded.

In a preferred embodiment, the covering is formed by laying two rectangular sheets one on top of the other and sewing three peripheral edges so that an opening is formed along the fourth peripheral edge. It should be understood that each of the two rectangular sheets should consist of two layers of loosely knit material. As previously described, an elastic band is provided along the opening so that the opening is naturally drawn shut.

BRIEF DESCRIPTION OF THE DRAWINGS

FIG. 1 is a perspective view of two sheets prior to sewing.

FIG. 1A is a perspective view of a single sheet of material prior to folding.

FIG. 2 is a perspective view of the two sheets of FIG. 1 after sewing.

FIG. 2A is a perspective view of the sheet of material of FIG. 1A after folding and sewing.

FIG. 3 is a perspective view of the outer covering and the polysponge core prior to insertion.

FIG. 4 is a perspective view of the assembled sponge and covering.

FIG. 5 is an enlarged view of the polishing cloth material.

DETAILED DESCRIPTION OF THE DRAWINGS

The loosely knitted material which forms the outer covering of the invention is illustrated in FIG. 5 which shows a looped fabric strand 8 which is characteristic of knitted material.

In the other drawings, the material is represented as rectangular sheets, but the surface detail has been omitted for clarity.

Referring now to FIG. 1A, a rectangular sheet of loosely knit material 1 has parallel and opposite sides 3,3 and 7,7. It should be understood that the sheet 1 preferably consists of a double layer of the loosely knitted material shown in FIG. 5. The rectangular sheet 1 has a surace 8 as shown in FIG. 5.

By folding the rectangular sheet 1 end to end about an imaginary fold axis 5, the rectangular sheet 1 will be transformed into a single rectangular sheet having two equal halves joined together along the fold axis.

FIG. 2A shows the rectangular sheet after folding. It should be noted that the folded sheet should be substantially two dimensional.

The two halves are then sewn together along mutual peripheral edges. In a preferred embodiment, the edges are defined by the sides 7,7 and the sides are sewn to form seams 9 and 11. Seams 9,11 are illustrated in FIG. 2A as two parallel broken lines running along sides 7,7.

Since only two of the four sides are sewn together, an opening is formed where the ends 3,3 were brought together after folding. Therefore, the rectangular sheet 1, after folding and sewing, takes the form of a pocket having a loosely knit surface 8 and an opening 3A.

In order to form the pocket, it is only necessary that two of the four sides be sewn together, since one of the four sides constitutes a contiguous border between the two halves, as defined by the fold axis 5. It is possible to sew together any two of the remaining three sides.

If the rectangular sheet 1 has an irregular shape, it is possible that a pocket may be formed after folding and sewing so long as an opening remains.

FIG. 1 shows another embodiment of the pocket. This embodiment requires two similar rectangular sheets 4 and 6 which, like the rectangular sheet 1 have loosely knit surfaces 8. Also, it should be understood that each sheet can consist of a double layer of loosely knit material 8. In the case of a double layer, each layer is independent from the other and only interconnected along the peripheral edges when the pocket is sewn as previously described. In the embodiment of FIG. 1, the two sheets 4 and 6 are placed one on top of the other. The two sheets are then sewn together along three peripheral edges, as shown in FIG. 2. Most of seams 14 and 18 are obscured from view and are shown by broken lines. The shape of the pocket formed in FIG. 2 after sewing is shown in block-like form, which is the shape the pocket will take after inserting a sponge core member having a block-like shape.

In either embodiment shown in FIG. 1 or 1A for forming the pocket, the opening is provided with an elastic band 13 which extends around the entire opening and is sewn to the opening while held in a stretched position so that when the band is released, the opening is elastically drawn shut as shown in FIG. 4. The elastic band 13 allows the sponge core 2 to be readily inserted and removed as required. For instance, FIG. 3 shows the pocket with the sponge 2 being inserted therein. FIG. 4 shows the finished product with an outer surface 8 which is understood to be loosely knitted material. The opening 3A is shown in a constricted position with the sponge inside. The band 13 forms a predominantly oval shape and guards against inadvertent removal of the sponge. As the product is used, and as hazy deposits build up on the surface 8, the sponge can be removed and the pocket can be turned inside out to present a clean buffing surface.

The seams described herein can be formed by stitching or by any other suitable means including adhesive bonding.

It is recognized that various minor modifications may be made in the structure without departing from the scope of the invention and therefore, the specification is intended not to limit the invention to a precise form other than that described in the attached claims.

What I claim is:

1. A polishing pad comprising:

a sponge core enveloped by a covering made from a double layer of soft, loosely knitted material wherein the covering is provided with an elastic band that defines an expandable opening, whereby the sponge core is insertable through the expandable opening and the covering is reversible, whereby, as polishing materials builds up in the outer surface of the covering, the sponge core can be removed and the covering reversed inside out to provide a clean polishing surface.

2. The polishing pad of claim 1 wherein the covering comprises two rectangular sheets sewn together along three peripheral edges.

3. The polishing pad of claim 2 wherein a fourth peripheral edge is provided with the elastic band that defines the expandable opening.

4. A covering for porous foam cores comprising, a body made of two layers of loosely knitted material, an opening at one end of the body for receiving a porous foam core, wherein an elastic band is sewn along the opening to form an endless loop, the elastic band being sewn to the material along the opening while in a stretched position, whereby when the elastic band is released, the opening is constricted.

5. The article of claim 4 wherein the body is formed from a rectangular sheet of loosely knitted polishing cloth.

6. The article of claim 4 wherein the body comprises upper and lower rectangular sheets of loosely knitted material sewn together along three peripheral edges.

7. The article of claim 6 wherein the opening is formed along the fourth unsewn edge of the rectangular sheets.

8. The article of claim 1 wherein the covering comprises a single sheet of double layered, loosely knitted material folded end to end to form two identical halves, two peripheral edges being sewn together to form a pocket having an interior and an opening leading to the interior.

* * * * *